US007737906B2

(12) United States Patent
Adamski

(10) Patent No.: US 7,737,906 B2
(45) Date of Patent: Jun. 15, 2010

(54) ELECTRONICALLY STEERED PHASED ARRAY BLADE ANTENNA ASSEMBLY

(75) Inventor: Piotr Roman Adamski, Port Hueneme, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 318 days.

(21) Appl. No.: 12/018,873

(22) Filed: Jan. 24, 2008

(65) Prior Publication Data

US 2009/0189823 A1 Jul. 30, 2009

(51) Int. Cl.
*H01Q 21/12* (2006.01)

(52) U.S. Cl. ..... 343/814

(58) Field of Classification Search ..... 343/814, 343/754, 795, 797, 853
See application file for complete search history.

(56) References Cited

U.S. PATENT DOCUMENTS 2,664,507 A * 12/1953 Mural ..... 343/795
3,702,479 A * 11/1972 Uhrig ..... 343/705
4,150,382 A * 4/1979 King ..... 343/754
4,434,425 A * 2/1984 Barbano ..... 343/797
4,814,777 A * 3/1989 Monser ..... 343/727
7,280,083 B1 * 10/2007 Adamski ..... 343/814

* cited by examiner

*Primary Examiner*—Tho G Phan
(74) *Attorney, Agent, or Firm*—Christopher Blackburn; Robert Lerma

(57) ABSTRACT

An antenna design, having two symmetrical phased array blade antenna elements which provide improved lateral target coverage with an increased effective radiated power and exhibits smooth null-free unidirectional antenna patterns. The direction of the unidirectional antenna pattern is dictated by a switching command under control of a user. Each blade antenna element is coupled to a 90-degree hybrid coupler and an RF switching device by a semi-rigid RF cable. Each blade antenna element is also connected to a sub-resonant choke balun for improved impedance matching and resultant distortion-less antenna patterns.

16 Claims, 4 Drawing Sheets

ELECTRONICALLY STEERED PHASED ARRAY BLADE ANTENNA ASSEMBLY

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

The present invention relates generally to an electronically steered radio frequency beam transmitted by a phased array blade antenna assembly for use on an airborne platform whose mission is electronic warfare. The electronically steered radio frequency beam is dynamically directed to either the left or right side of the airborne platform in order to directionally maximize the power of the radiated radio frequency signal.

2. Description of the Prior Art

The industry has a number of airborne antennas used with different airborne amplifiers and covering a broad range of frequencies. However, most of the antennas, especially those covering lower frequency bands, provide less than optimal pattern coverage and thus reduced Effective Radiated Power (ERP) performance. An attempt to address these problems can be found in a U.S. Pat. No. 7,280,083 issued to this inventor. Although the '083 patent reference provides added benefits of good impedance stability versus frequency and stable monotonic antenna pattern characteristics in proximity to an irregular ground plane, the overall design approach imposes the following limitations: the design has an inherent bidirectional antenna pattern vice a unidirectional antenna pattern, a lower amount of radiated power is directed towards the intended target as a result of the bidirectional antenna pattern, the antenna pattern is fixed to radiate symmetrically from the host platform vice a left only or right only radiation pattern, the phased array blade antenna described in the '083 patent reference is not capable of switching the direction of radiation in response to control commands and most importantly, the reference results in a lower gain and thus a shorter standoff distance between a jammer and a target.

There are no known airborne antenna designs in the prior art that will operate in the desired frequency range, at the desired power level, respond to main lobe directional control commands and increases the standoff distance between the jammer and the target. The increased standoff distance provided by the directionally controlled antenna pattern is important in raising the probability of mission success by moving the jamming aircraft further from potential threats. In addition, the unidirectional antenna pattern provides enhanced control of undesirable ownership EMI effects and a potential of significant fratricide reduction.

SUMMARY OF THE INVENTION

An Electronically Steered Phased Array Blade Antenna (EASB) Assembly is an apparatus comprised of a pair of dipole antenna elements spaced apart from one another by a preset distance where the preset distance is a function of the radiated wavelength. The pair of dipole antenna elements are comprised of two symmetrical antenna blades with each antenna blade having a fan out angle of approximately 45 degrees. An electronically controlled radio frequency (RF) switching device and a 90-degree hybrid coupler, in combination, route the RF input signal to one of the two symmetrical antenna blades.

A pair of coiled RF feed lines connect the pair of dipole antenna elements to the RF switching device and the 90 degree hybrid coupler combination, each of the pair of coiled RF feed lines operates as a balun for impedance matching purposes. All of the above described components are rigidly mounted to a dielectric substrate. Clamps are used to mount the dielectric substrate within a radome.

The antenna design comprises a two-element phased array blade antenna (PAB) assembly which provides improved lateral target coverage with an increased effective radiated power and exhibits a smooth null-free unidirectional lateral antenna pattern. Each blade is coupled to the RF switching device and 90 degree hybrid coupler combination by a semi-rigid Radio Frequency (RF) cable through a sub-resonant choke balun for improved impedance matching.

This antenna design provides a superior antenna input Voltage Standing Wave Ratio (VSWR), smooth pattern coverage and large antenna gain. Moreover, broadband antenna performance is achieved with a unique antenna blade design that not only improves the usable frequency range of the antenna, but also provides for a light weight construction that is required for most airborne antenna systems.

Another unique feature of this antenna array design is the fact that it does not require any impedance matching networks since the antenna blade construction features a nominal input impedance of fifty ohms. This feature is a major antenna design simplification directly reducing construction cost, increasing reliability and also reducing RF insertion loss. The transformation of an unbalanced RF input coaxial cable to a balanced configuration is accomplished with two sub-resonant choke baluns, each made out of a coiled semi-rigid RF feed cable. This approach gives the lowest cost antenna balun implementation with more than adequate performance and most of all maximum design simplicity. The innovative antenna blade design provides a well-behaved antenna input impedance characteristic that covers approximately 22% of the bandwidth around the center or target design frequency.

BRIEF DESCRIPTION OF THE DRAWINGS

The features described above, other features, aspects, and advantages of the present invention will become better understood with regard to the following description, appended claims, and accompanying drawings where:

DETAILED DESCRIPTION OF THE PREFERRED EMBODIMENT

Figure 1:
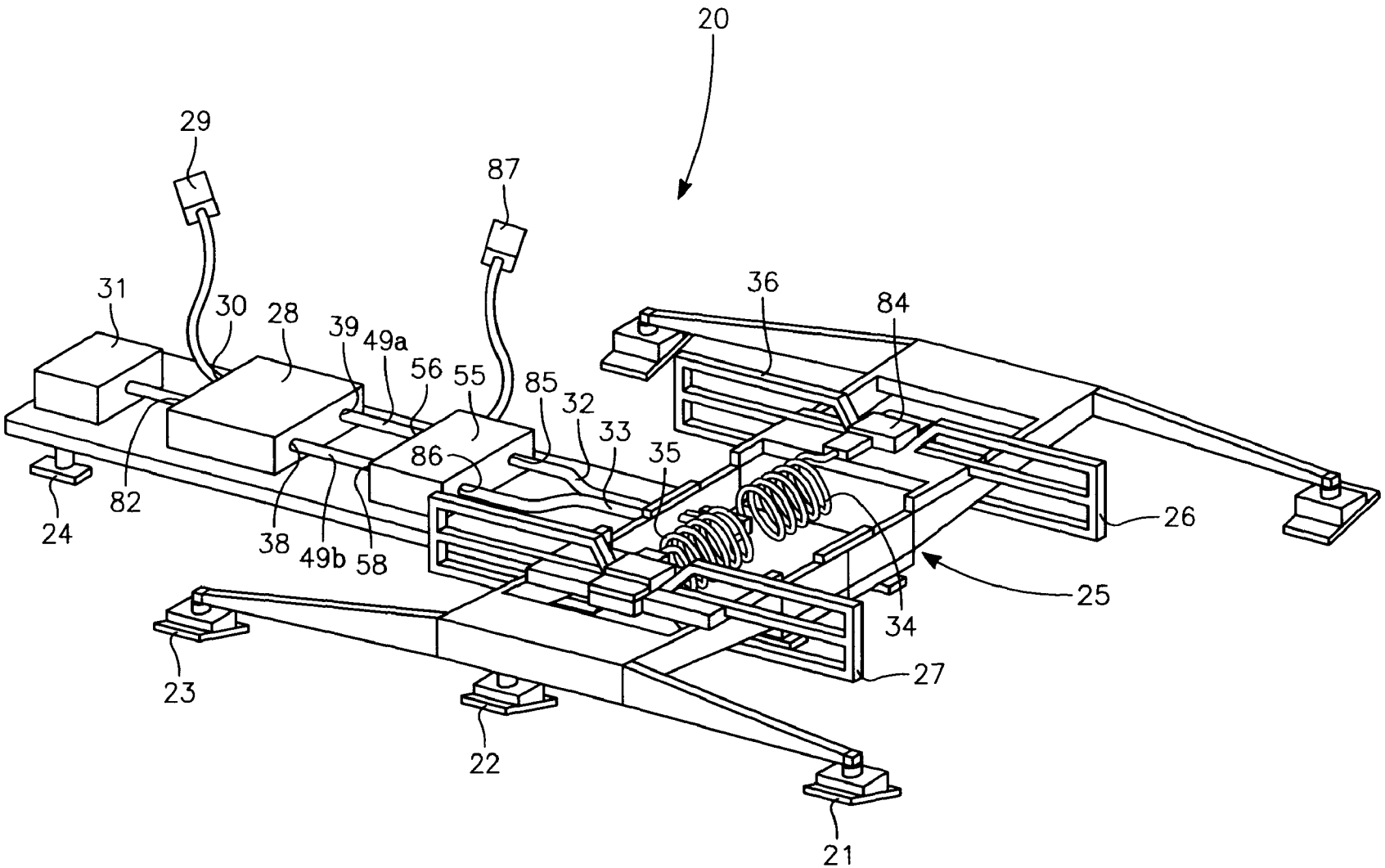
FIG. 1 is a view of the Electronically Steered Phased Array Blade (ESPAB) assembly and mounting structure.

The preferred embodiment of the electronically steered phased array blade (ESPAB) antenna assembly 20 is shown in FIG. 1. The ESPAB antenna assembly 20 fits within the constraints of a radome intended for use on an aircraft. Clamps 21, 22, 23 and 24 are mounted on a structure made of a dielectric substrate 25 and placed as shown to anchor the ESPAB antenna assembly 20 to the radome. The quantity of clamps mounted on the dielectric substrate 25 can be increased in order to achieve the desired stability.

The ESPAB antenna assembly 20 of FIG. 1 contains two modified dipole antenna elements 26 and 27 spatially separated by a distance approximated by $\lambda/4$. This design requires that the dipole element separation be set to accommodate the center frequency of interest. Due to the radome's internal spatial constraints, the dipole element spacing deviation from $\lambda/4$, within +/−20%, will also provide acceptable performance of the antenna assembly 20.

The RF signal that feeds the ESPAB antenna assembly 20 is split equally in amplitude and shifted 90 degrees out of phase. This signal split and phase shift is accomplished with a device known in the art as a broadband high power 90-degree hybrid coupler 28, which is commercially available for either low or high RF power applications from a number of vendors. The input RF is connected to the 90-degree hybrid coupler 28 via an RF input cable 29 which is connected directly to the input port 30 of the broadband high power 90 degree hybrid coupler 28. The benefit of using the 90-degree hybrid coupler 28 is that it dissipates common mode currents as heat into a dummy load 31 which is connected to an unused isolation input port 82 of the 90 degree hybrid coupler 28. A pair of signal output ports (38 and 39) of the 90-degree hybrid coupler 28 is connected to a pair of input ports (58 and 56) of an RF transfer switch 55 by a pair of RF lines (49*b* and 49*a*).

Figure 2:
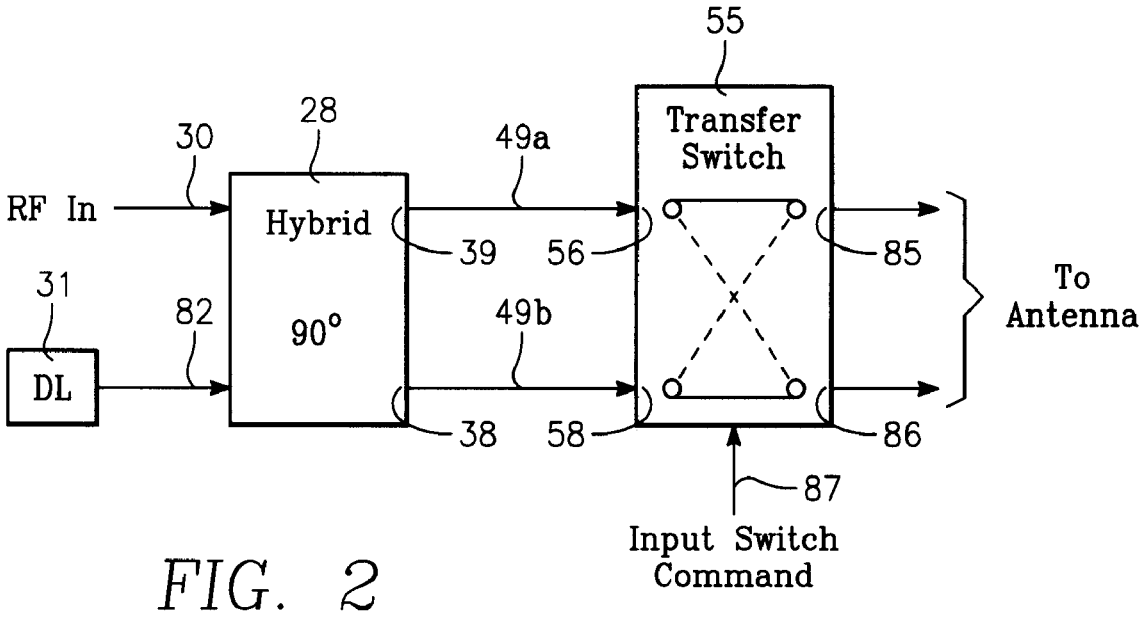
FIG. 2 is a view of the preferred embodiment, a 90 degree hybrid coupler followed by and connected to an RF switching device, in a combination. The combination is also referred to as the coupler switching device, where the RF switching device is a Transfer Switch.

Referring to FIG. 2, one suitable RF transfer switch 55 has a part number of (KC)310C00100 and is available from Dow Key Microwave products. The preferred RF transfer switch 55 accepts an input switching command 87 for use in switching the RF at input port 56 to either RF output port 85 or to RF output port 86. The ability of the RF transfer switch to select either RF output port 85 or RF output port 86 effectively controlling the relative 90-degree phase lag-lead between the two ports, per the input switching command 87, is the mechanization by which the transmitted RF is directed out of either the left side or the right side of the radome (not shown).

Referring to FIG. 1, the RF output port 85 and the RF output port 86 are symmetrically connected to the antenna dipoles 26 and 27 via two separate semi-rigid RF feed cables 32 and 33, each having equal electrical length. The RF feed cables 32 and 33 are specially formed to serve as both a high power RF feed line and as a sub-resonant choke balun, which is necessary for correct antenna operation. The balun consists of the semi-rigid RF feed cable wound in the form of a coil. The coils 34 and 35 which form the balun, provide a high impedance inductive load as seen by the outside surface of the RF cable 32 and the RF cable 33. The purpose of the balun is to suppress the unbalanced currents attempting to flow on the surface of the outer conductor of RF cables 32 and 33.

The components that comprise the ESPAB antenna assembly 20 described above are mounted onto the dielectric substrate 25. The basis of the ESPAB antenna assembly's strength and rigidity is attributed to the mechanical properties of the dielectric material used as the dielectric substrate 25. The dielectric material chosen for the dielectric substrate 25 has the characteristics of having a low relative permittivity constant, preferably in the range of 2 to 3, and possesses a low Loss Tangent property. The use of the dielectric substrate 25 is necessary for mechanical strength and rigidity to support the assemblage. The selected dielectric material should be as electrically transparent as possible, including low loss tangent, so as not to interfere with the environmental and electrical operation of the antenna assembly 20.

Figure 4:
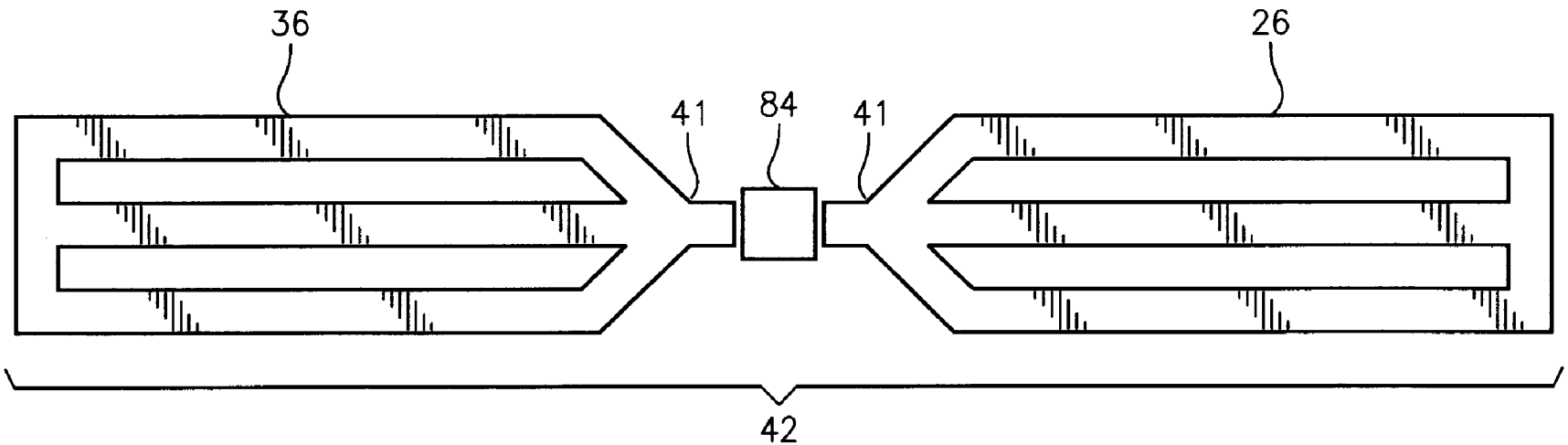
FIG. 4 is a view of the antenna blade construction for the ESPAB assembly of FIG. 1.

Referring to FIG. 4, each antenna dipole element 42 consists of two symmetrical blades 26 and 36. The design of each blade 26 and 36 affords lightweight construction and also minimizes wind loading should the antenna be used in other than airborne applications. Antenna blades 26 and 36 have a fan out angle (item 41) of 45 degrees as shown. The fan out angle (item 41) of 45 degrees contributes to the dipole element impedance reduction from 73 ohms down to 50 ohms to match the impedance of the semi-rigid RF feed cable 32 and 33 and thus obviates the need for an impedance matching network. This desirable broadband antenna impedance behavior and thus ultra low VSWR are all attributed to the peculiar three-prong antenna shape and the taper angle (item 41) of 45 degrees, where the symmetrical blade elements (items 26 and 36) make up the blade array antenna 42. The geometry of each blade (items 26 and 36) has an effect of extending the antenna frequency bandwidth to about 22%.

Figure 5:
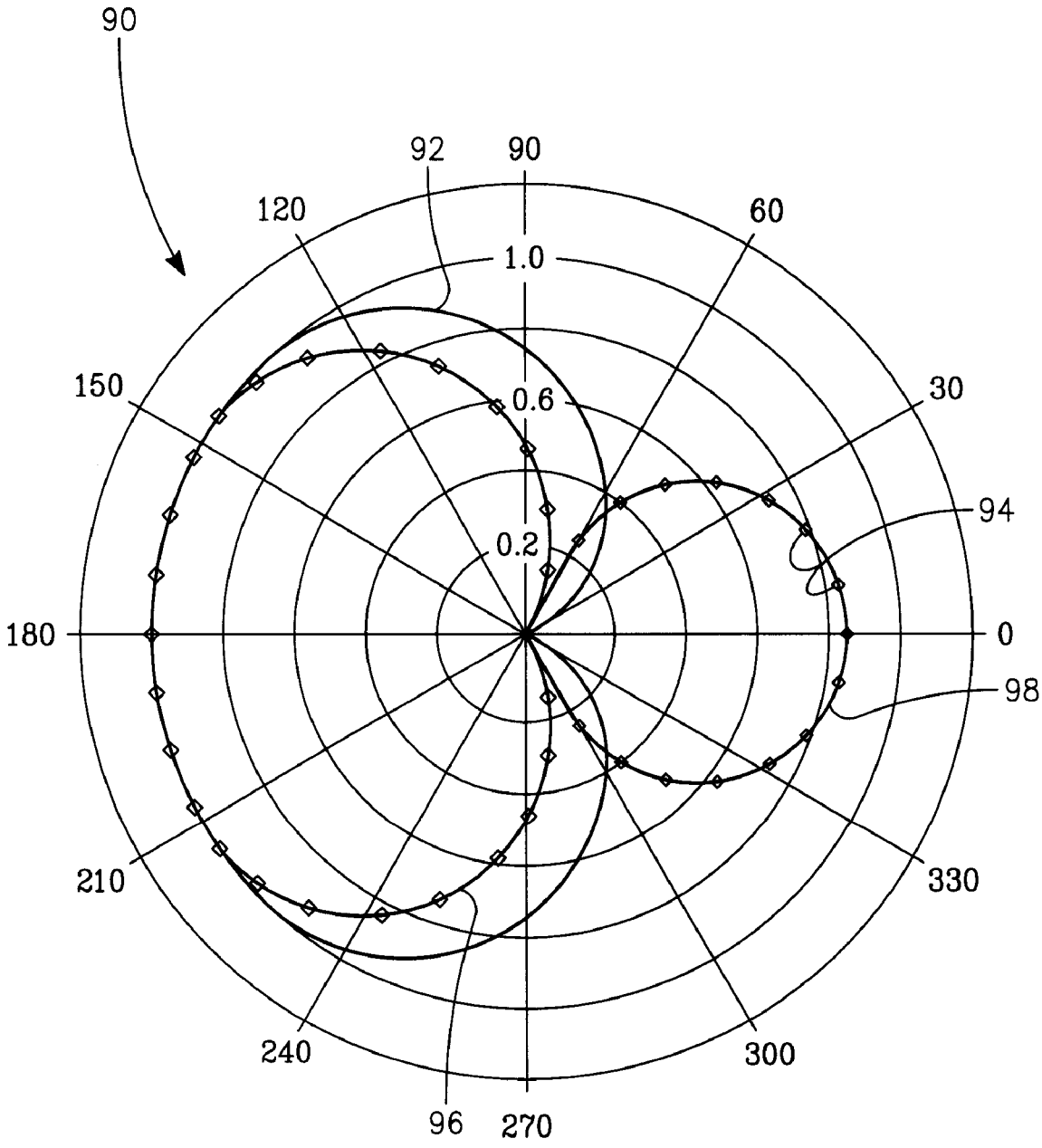
FIG. 5 is a polar plot for the ESPAB simulated radiating elevation pattern as predicted before being installed on an aircraft.

The calculated antennae pattern of FIG. 5 shows the unidirectional characteristic inherent in the ESPAB antenna assembly 20. The polar plot 90 depicts the idealized antenna pattern 92 alongside the simulated antenna pattern points 94. From the polar plot 90 it is evident that the calculated main lobe 96 and back lobe 98, constructed by connecting the measured antenna pattern points 94, exhibits a unidirectional shape. That is, the main lobe 96 contains a larger portion of the radiated energy which is transmitted in the commanded direction. By commanding the RF transfer switch to radiate in the opposite direction the main lobe and back lobe can be switched 180 degrees allowing the main lobe to transmit in the opposite direction.

Referring to FIG. 1, the RF feed line connection 84 to the antenna blade elements 26 and 36 can be accomplished in a number of ways depending upon whether it is desired to have the blades interchangeable or not. The simplest method would be to drill holes corresponding to the outer and inner diameter of the feed line 34 in the two antenna blades 26 and 36, respectively. Another method to achieve blade design commonality would be to have standard feed-thru adapter connectors installed in the threaded RF input orifices, one for the outer conductor and the other for the inner conductor, ensuring that precise electrical isolation exists between the two conductors. If the antenna blades 26 and 36 are constructed of a material that is dissimilar to that of the RF feed line's 34 metallic outer and inner conductor, a special design approach must be considered to prevent the dissimilar metal galvanic corrosion phenomenon. Towards that end, preventing moisture penetration is a critical strategy to inhibit galvanic corrosion if direct contact between two dissimilar metals cannot be avoided.

The preferred embodiment is most useful in a scenario in which a jamming aircraft is configured to carry an external pod with the ESPAB assembly installed. The aircrew may then fly the jamming aircraft along a flight profile, and using the orientation of the target location relative to the external pod, the aircrew may command the RF to radiate in a direction that focuses the main lobe of the antenna pattern on the target.

As the jamming aircraft changes the orientation of the target location relative to the external pod the aircrew may refocus the main lobe of the antenna pattern on the target by sending the RF switching command.

Figure 3:
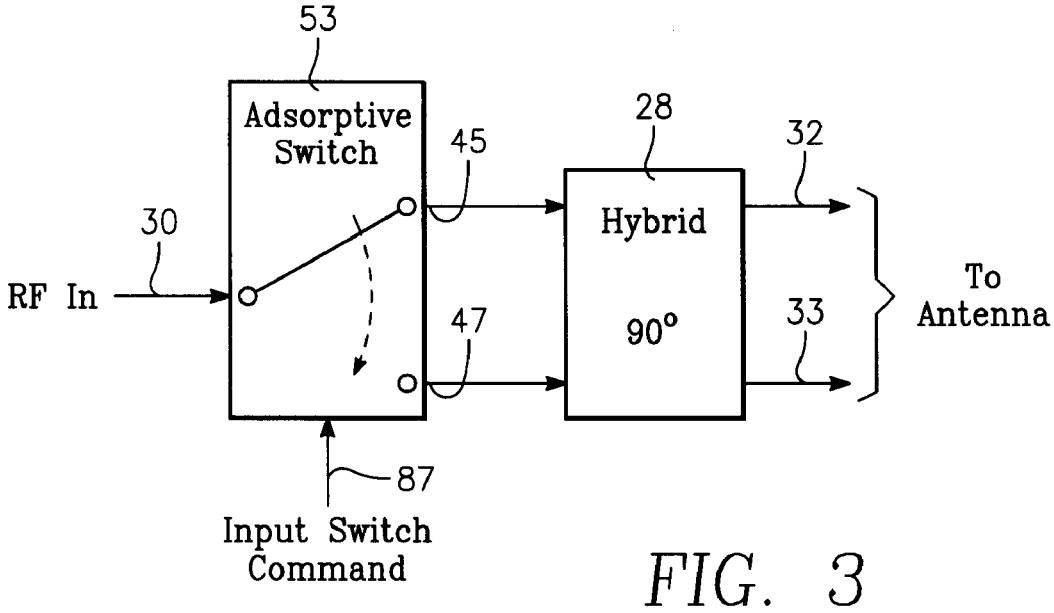
FIG. 3 is a view of the RF switching device followed by and connected to a 90-degree hybrid coupler, in a combination. The combination is also referred to as the coupler switching device, where the RF switching device is an Absorptive SPDT RF Switch, another embodiment.

Referring to FIG. 3, another embodiment of the ESPAB uses an absorptive RF switching device 53 in place of the RF transfer switch (FIG. 2 item 55). Additionally, the position of the 90 degree hybrid coupler 28 and the absorptive RF switching device 53 are swapped. The swapped position results in the absorptive RF switching device 53 accepting the RF input 30 and switching the RF input 30 to either output port 45 or output port 47, depending upon the state of the input switching command 87. The RF available at either output port 45 or 47 is then fed into the 90 degree hybrid coupler 28, controlling the necessary relative 90-degree phase lag-lead shift, for further RF coupling to the respective antenna blade via RF feed line connection 84, as shown in FIG. 1.

One advantage of using the absorptive RF switching device 53 is that no dummy load is required. One disadvantage of using the absorptive RF switching device 53 is that it must have much higher RF power rating as compared to the preferred embodiment using the RF transfer switch implementation (FIG. 2 item 55). An absorptive switch produced by Comtech PST Corporation has a peak power limit of two kilowatts and an average power limit of eighty watts. Due to manufacturing difficulties, the average RF power handling constraints of the absorptive RF switching device 53 is usually orders of magnitude lower than that of the reflective electro-mechanical RF transfer switch 55. For some applications, a lower average power rating may be adequate.

From the foregoing, it may readily be seen that the present invention comprises a new, unique and exceedingly useful and effective electronically steerable blade array antenna system which includes a pair of lightweight dipole blades designed to fit within a radome which constitutes a considerable improvement over the known prior art. Many modifications and variations of the present inventions are possible in light of the above teachings. It is therefore to be understood that within the scope of the claims the invention may be practiced otherwise than as specifically described

What is claimed is:

1. An Electronically Steered Phased Array Blade Antenna Assembly comprising:

a pair of dipole antenna elements spaced apart from one another by a preset distance, wherein the pair of dipole antenna elements includes two symmetrical antenna blades with each of the antenna blades having a fan out angle of approximately 45 degrees;

a 90 degree hybrid coupler having a pair of input radio frequency (RF) ports and a pair of RF output ports wherein one of the pair of input RF ports is connected to a dummy load, and a remaining input RF port is connected to an RF source;

an electronically controlled RF switching device having a switching command input port for receiving a switching command, a pair of RF input ports and a pair of RF output ports, wherein the pair of RF input ports of the electronically controlled radio frequency RF switching device receives the RF source from the RF output ports of the 90 degree hybrid coupler and the second pair of output ports of the electronically controlled RF switching device are connected to the pair of dipole antenna elements;

a pair of coiled RF feed lines connecting the pair of dipole antenna elements to the pair of RF output ports of the electronically controlled RF switching device, wherein each of the pair of coiled RF feed lines operates as a balun; and said pair of dipole antenna elements, said electronically controlled RF switching device and said pair of coiled RF feed lines being rigidly mounted to a dielectric substrate, wherein a plurality of clamps are mounted on the dielectric substrate at selected points to achieve structural stability when the electronically steered phased array blade antenna assembly is attached to and positioned within a radome.

2. The Electronically Steered Phased Array Blade Antenna Assembly of claim 1, wherein each of the pair of coiled RF feed lines are coiled to create the balun wherein the balun is a sub-resonant choke balun facilitating an impedance matching value of 50 ohms.

3. The Electronically Steered Phased Array Blade Antenna Assembly of claim 1, wherein the dielectric substrate has a characteristic of a low relative permittivity constant, preferably in a range of 2 to 3 and a low Loss Tangent property.

4. The Electronically Steered Phased Array Blade Antenna Assembly of claim 1, wherein the electronically controlled RF switching device is a fail safe transfer switch.

5. The Electronically Steered Phased Array Blade Antenna Assembly of claim 1, wherein the electronically controlled RF switching device is an absorptive switch connected between the RF source and the 90 degree hybrid coupler and the 90 degree hybrid coupler is further connected to the pair of dipole antenna elements.

6. An Electronically Steered Phased Array Blade Antenna Assembly, comprising:

coupler switching means for connecting an RF signal to a pair of RF output ports wherein the coupler switching means is electronically controlled to select one of the pair of RF output ports;

radiating means for transforming the RF signal received from one of the pair of RF output ports into a radar beam;

impedance matching means for coupling the pair of RF output ports of the coupler switching means to the radiating means; and structure means for rigidly mounting the coupler switching means, the radiating means and the impedance matching means thereon, wherein the structure means accepts a plurality of clamps at selected points to achieve a structural stability when said electronically steered phased array blade antenna assembly is attached to and positioned within a radome.

7. The Electronically Steered Phased Array Blade Antenna Assembly of claim 6, wherein the coupling switching means is a combination of a 90 degree hybrid coupler and a fail safe transfer switch.

8. The Electronically Steered Phased Array Blade Antenna Assembly of claim 6, wherein the coupler switching means is a combination of an absorptive switch and a 90 degree hybrid coupler.

9. The Electronically Steered Phased Array Blade Antenna Assembly of claim 6, wherein the radiating means is a pair of symmetrical antenna blades each having a unidirectional radiation pattern, with each of the antenna blades having a fan out angle of approximately 45 degrees.

10. The Electronically Steered Phased Array Blade Antenna Assembly of claim 6, wherein the impedance matching means is a pair of coiled RF feed lines acting as a balun which are used to obtain 50 ohms of impedance between the radiating means and the coupler switching means.

11. The Electronically Steered Phased Array Blade Antenna Assembly of claim 6, wherein the structure means is a dielectric substrate material having a characteristic of a low relative permittivity constant, preferably in a range of 2 to 3 for reducing an attenuation of a unidirectional radiation pattern.

12. The Electronically Steered Phased Array Blade Antenna Assembly of claim 6, wherein the coupler switching means includes a fail safe transfer switch wherein the fail safe transfer switch directionally controls a unidirectional radar beam.

13. The Electronically Steered Phased Array Blade Antenna Assembly of claim 6, wherein the coupler switching means is an absorptive switch, the absorptive switch directionally controlling a unidirectional radar beam.

14. An Electronically Steered Phased Array Blade Antenna Assembly comprising:

a pair of symmetrical dipole antenna elements positioned apart from one another by a selected distance, wherein each one of the pair of symmetrical dipole antenna elements consist of a first blade electrically and a second blade, said first blade being mechanically coupled to said second blade with each of said first and second blades having a fan out angle of 45 degrees providing an impedance of 50 ohms;

a coupler switching device having an electrical RF input port and a set of electrical RF signal output ports, wherein said coupler switching device receives an input electrical RF signal and connects said input electrical RF signal to one of the symmetrical dipole antenna elements which in response to said input RF electrical signal generates a unidirectional radiation pattern;

a pair of coiled RF feed lines connecting the pair of symmetrical dipole antenna elements to the electrical RF output ports of said phase coupler switching device, wherein each of the coiled RF feed lines operates as a balun maintaining 50 ohms of impedance matching to minimize signal loss present in the connection of said symmetrical dipole antenna elements to said coupler switching device; and said pair of symmetrical dipole antenna elements, said coupler switch device and said pair of coiled RF feed lines being rigidly mounted to a dielectric substrate by a plurality of clamps connected to the dielectric substrate at a plurality of selected points to achieve structural stability when mounting the electronically steered phased array blade assembly within a radome.

15. The Electronically Steered Phased Array Blade Antenna Assembly of claim 14, wherein the coupler switching device includes a 90 degree hybrid device connected to a fail safe transfer switch.

16. The Electronically Steered Phased Array Blade Antenna Assembly of claim 14, wherein the coupler switching device includes an absorptive switch connected to a 90 degree hybrid device.

* * * * *